US007583488B2

(12) United States Patent
Neumetzler et al.

(10) Patent No.: US 7,583,488 B2
(45) Date of Patent: Sep. 1, 2009

(54) OVERVOLTAGE PROTECTION MAGAZINE FOR A DEVICE OF TELECOMMUNICATIONS TECHNOLOGY

(75) Inventors: Heiko Neumetzler, Berlin (DE); Johann Oltmanns, Berlin (DE); Harald Klein, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 10/553,314

(22) PCT Filed: Mar. 26, 2004

(86) PCT No.: PCT/EP2004/003231

§ 371 (c)(1),
(2), (4) Date: Nov. 6, 2006

(87) PCT Pub. No.: WO2004/093275

PCT Pub. Date: Oct. 28, 2004

(65) Prior Publication Data

US 2007/0064373 A1 Mar. 22, 2007

(30) Foreign Application Priority Data

Apr. 16, 2003 (DE) ..... 103 17 621

(51) Int. Cl.
*H01C 7/13* (2006.01)

(52) U.S. Cl. ..... 361/119

(58) Field of Classification Search ..... 361/119
See application file for complete search history.

(56) References Cited

U.S. PATENT DOCUMENTS 4,496,803 A * 1/1985 Smith ..... 200/5 A
5,175,662 A * 12/1992 DeBalko et al. ..... 361/119
5,643,014 A * 7/1997 Filus et al. ..... 439/680
5,755,026 A * 5/1998 Stephan et al. ..... 29/846
5,844,785 A * 12/1998 Daoud et al. ..... 361/824
6,166,894 A * 12/2000 Kane ..... 361/119

FOREIGN PATENT DOCUMENTS

| | | |
|---|---|---|
| AU | 755266 | 11/1999 |
| DE | 34 30 922 | 3/1986 |
| DE | 42 36 584 | 6/1993 |
| DE | 198 18 477 | 10/1999 |
| EP | 2328/90 | 12/1990 |
| EP | 0 410 140 | 1/1991 |
| EP | 0 460 223 | 12/1991 |
| WO | WO 97/37407 | 10/1997 |
| WO | WO 97/37408 | 10/1997 |
| WO | WO 97/49151 | 12/1997 |
| WO | WO 01/97332 | 12/2001 |

* cited by examiner

*Primary Examiner*—Robert DeBeradinis
*Assistant Examiner*—Scott Bauer
(74) *Attorney, Agent, or Firm*—Merchant & Gould P.C.

(57) ABSTRACT

The invention relates to an overvoltage protection magazine for a telecommunications device, comprising a housing, a printed circuit board, two or more surge arresters and at least one ground contact, the surge arresters being arranged on the printed circuit board and being passed via conductor tracks to contact pads arranged on the printed circuit board which, when plugged in, come into electrical contact with contacts of the telecommunications device, the surge arresters being arranged in a row.

14 Claims, 3 Drawing Sheets

OVERVOLTAGE PROTECTION MAGAZINE FOR A DEVICE OF TELECOMMUNICATIONS TECHNOLOGY

TECHNICAL FIELD

The invention relates to an overvoltage protection magazine for a telecommunications device.

BACKGROUND

DE 34 30 922 A1 discloses a surge arrester and fuse magazine in which, for each conductance path with supply line and output line, a fuse and/or a dual surge arrester can be clamped into a holder in the overvoltage protection magazine by means of contact springs, one contact track being provided as the disconnection element at the front and at the rear for each conductance path on the bottom of the overvoltage protection magazine which can be plugged in, each contact track being connected to one pole of the fuse, the poles of the fuses each being connected to one pole of the dual surge arrester and the center contacts of the dual surge arresters being positioned on a common ground rail which is connected to two ground tap terminals. One disadvantage of the known overvoltage protection magazine is the large amount of physical space it requires, in particular since both the dual surge arrester and the fuses are in each case arranged in two rows.

DE 198 18 477 A1 discloses an overvoltage protection magazine for a telecommunications device having a housing, two or more contacts, a section of which extends from the rear of the housing and which, when assembled, touch contacts of the telecommunications device, and at least one ground contact, it being possible for two or more surge arresters to be inserted into the overvoltage protection magazine, said arresters having legs which, when inserted, are electrically conductively connected directly to the contacts, the contacts each having a contact slot which is defined by two contact limbs lying predominantly on the same plane, it being possible for the surge arresters to be inserted from the front of the housing in the direction of their legs such that, when inserted, the respective leg extends into the contact slot in a direction predominantly parallel to said contact slot, and the surge arresters are located alternately on at least two different levels as regards the depth dimension of the overvoltage protection magazine such that they are arranged offset from one another when viewed from above. This makes it unnecessary to provide a printed circuit board in the overvoltage protection magazine. Disadvantages of the known overvoltage protection magazine include the comparatively large amount of physical space which is still required and the very high production complexity.

SUMMARY

The invention is therefore based on the technical problem of providing an overvoltage protection magazine which is simple to produce and requires only a small amount of physical space.

In this regard, the surge arresters are arranged in a row on a printed circuit board. This allows for simple construction and simple routing of the conductor tracks whilst being able to keep the printed circuit board relatively small.

The surge arresters are preferably in the form of SMD surge arresters, making it possible to mount components on the printed circuit board in a simple manner. A further advantage of the SMD components is that they are easier to recycle. By heating the printed circuit board, the SMD components fall off, making it easy to separate the printed circuit board and the surge arresters. In the case of surge arresters having contact legs, on the other hand, there are often bends, making it necessary to separate the components from the printed circuit board manually.

In a further preferred embodiment, the housing is integral, which reduces production costs. This is possible, in particular, since contact with the electrical contacts of the device is made via the contact pads on the printed circuit board. Since the printed circuit board is relatively robust, the structured printed circuit board can easily be pushed through openings provided in the housing. In embodiments from the prior art in which separate contacts are soldered to the printed circuit board or fixed directly to the surge arresters, there is a relatively large gap between the contacts, making integral housings impractical.

In a further preferred embodiment, the housing is open at the top and covered by an insulator strip. This is a simple means of providing protection for the user against electric shocks. The insulator strip is preferably in the form of a plastic strip which may also be used, if necessary, as a label.

In a further preferred embodiment, the inner sides of the housing are provided with supports for the insulator strip in order to provide sufficient support for this strip on the housing.

In a further preferred embodiment, the housing is provided with semicylindrical recesses which are provided with slots in the region of the top of the housing, the insulator strip being passed between the slots. In addition to a sufficient contact area being provided, this fixes the insulator strip and mechanically stabilizes the housing.

In a further preferred embodiment, the edges at the top of the housing are set back at the sides such that the insulator strip is flush with the top of the housing. This means that the edges of the housing do not press into the installer's fingers when the overvoltage magazine is pushed in and that the installer can apply pressure over the entire width.

In a further preferred embodiment, the housing is provided on the end side with at least one slot by means of which the insulator strip can be levered out using a tool.

In a further preferred embodiment, the ground contact is in the form of a fork contact and is connected to the printed circuit board via the fork contact, the fork contact preferably being in the form of a dual fork contact. This makes it possible to connect the fork contact to the printed circuit board without soldering.

In a further preferred embodiment, the surge arresters are fail-safe.

In a further preferred embodiment, the contact pads of the printed circuit board are made of silver, since silver has sufficient mechanical strength.

In a further preferred embodiment, the bottom of the housing is provided with cutouts in the region of the fork contacts such that the overvoltage protection magazine can easily be levered out using a tool when it is plugged onto a distribution strip.

The invention is explained in more detail below with reference to a preferred exemplary embodiment. In the figures:

DETAILED DESCRIPTION

Figure 1:
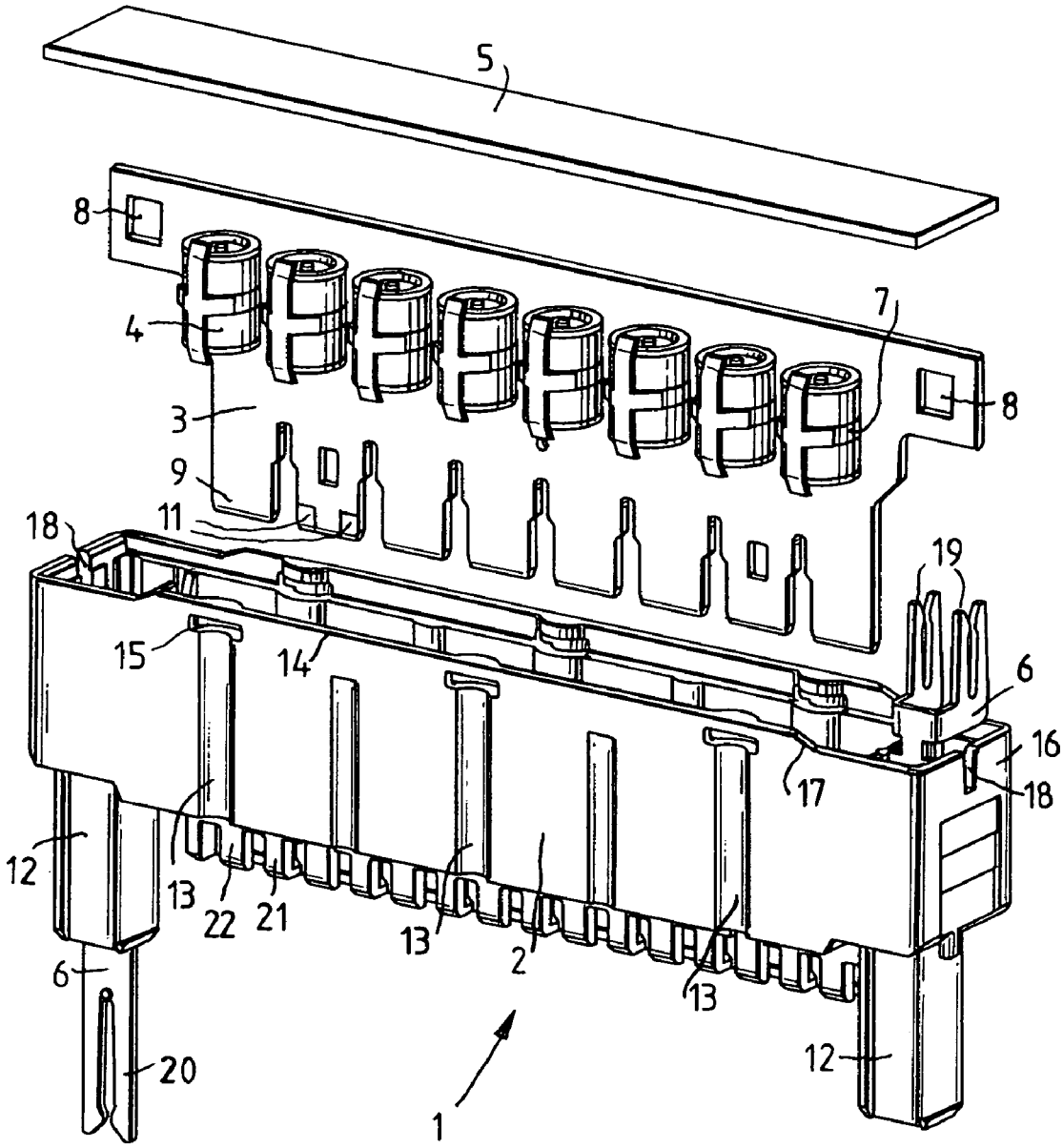
FIG. 1 shows an exploded illustration of an overvoltage protection magazine.

FIG. 1 shows an exploded illustration of the overvoltage protection magazine 1 prior to its assembly. The overvoltage protection magazine 1 comprises an integral housing 2, a printed circuit board 3 having surge arresters 4, an insulator strip 5 and two ground contacts 6. The surge arresters 4 are in the form of SMD components and are arranged in a row on the printed circuit board 3. The center contacts 7 of all of the surge arresters 6 are connected to two contact pads 8 via a common conductor track (not shown). The contact pads 8 are in this case arranged both on the front and on the rear of the printed circuit board 3. In the lower region, the printed circuit board 3 is structured such that it has cutouts, forming plug-in regions 9 corresponding to the number of surge arresters 4. For each plug-in region 9, the two outer electrodes of the surge arrester 4 associated with it are guided by conductor tracks, a contact pad 11 for each electrode being arranged in the edge region of the printed circuit board 3. The contact pads 11 are likewise arranged on the front and rear of the printed circuit board 3. The integral housing 2 is essentially cuboid. The housing 2 is provided with extensions 12 in its side regions. Furthermore, the housing 2 is provided with semicylindrical recesses 13. In the region of the upper edge 14, slots 15 are incorporated in the housing 2, dividing the inwardly projecting semicylinder. The upper edge 14 is set back toward the two end sides 16 by a slope 17, that is to say it is flatter. Furthermore, the housing 2 has slots 18 in the end sides 16. The ground contact 6 has a dual fork contact 19 in the upper region and a single fork contact 20 in the lower region. The housing 2 is furthermore provided in the lower region with openings for the plug-in regions 9. Closed webs 21 which each lie between two plug-in regions 9 and webs 22 which are slotted and rest between the two contact pads 11 are provided for robustness. For assembly, initially the two ground contacts 6 are plugged into the housing 2 from above, the ground contacts being guided by the extensions 12 when plugged in. When completely plugged in, the single fork contact 20 projects from the extension 12 as shown in the left-hand part of FIG. 1. Then, the printed circuit board 3 is pushed in, the plug-in regions 9 entering the housing 2 through the lower openings. At the same time, the dual fork contacts 19 make contact with the contact pads 8. In the final step, the insulator strip 5 is then pushed into the housing 2 such that the edges of the insulator strip 5 enter the slots 15. Hereby, the insulator strip 5 rests on the lower part of the semicylinder and is held by the upper part of the semicylinder. In this case, the insulator strip 5 lies on the same plane as the edge of the housing in the side regions on the slopes 17.

Figure 2:
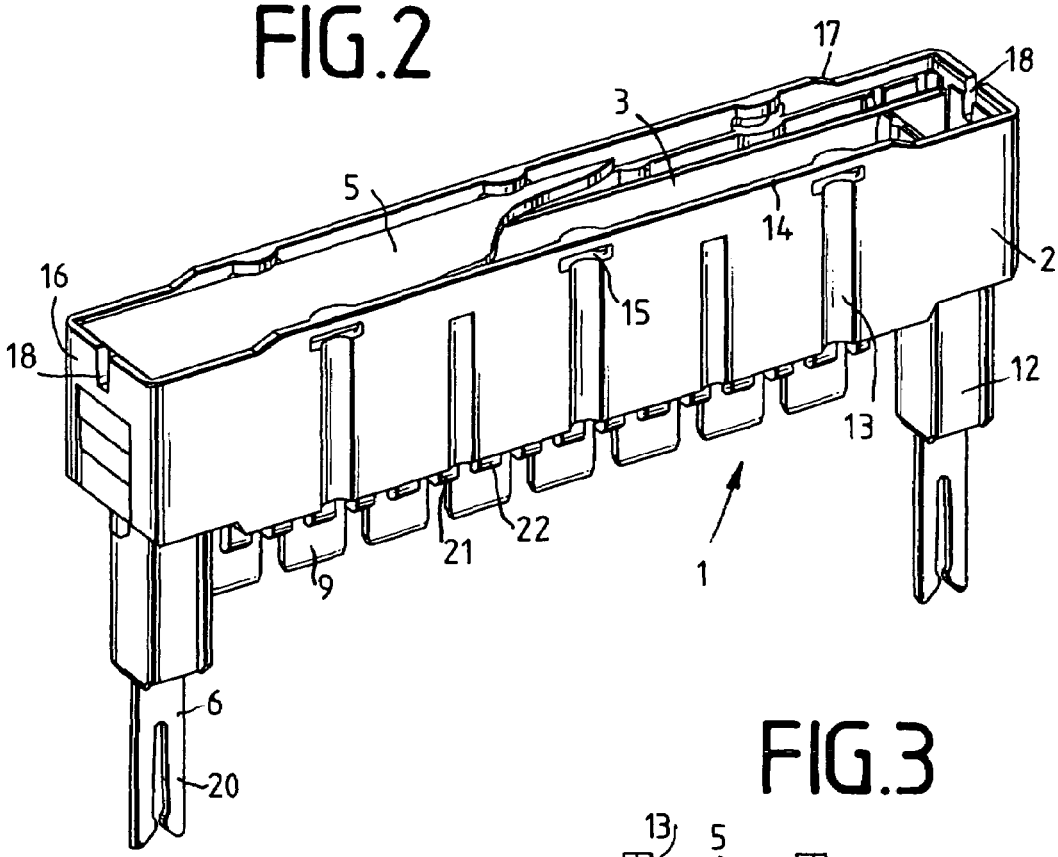
FIG. 2 shows a perspective illustration of an assembled overvoltage protection magazine.
Figure 3:
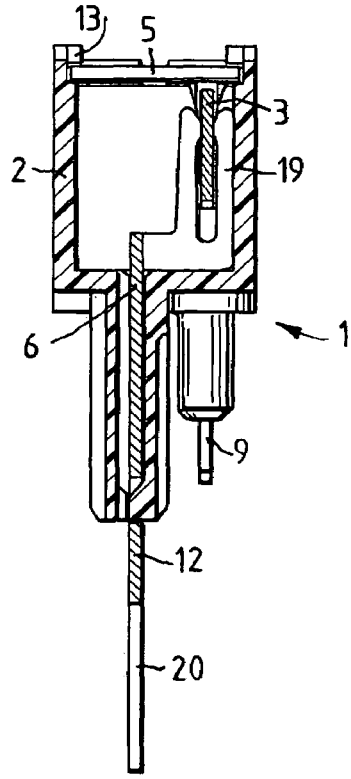
FIG. 3 shows a sectional illustration through the overvoltage protection magazine.

FIGS. 2 and 3 show the overvoltage protection magazine 1 when assembled, the insulator strip 5 being illustrated broken off in FIG. 2 and the same reference numerals being used as for FIG. 1.

Figure 4:
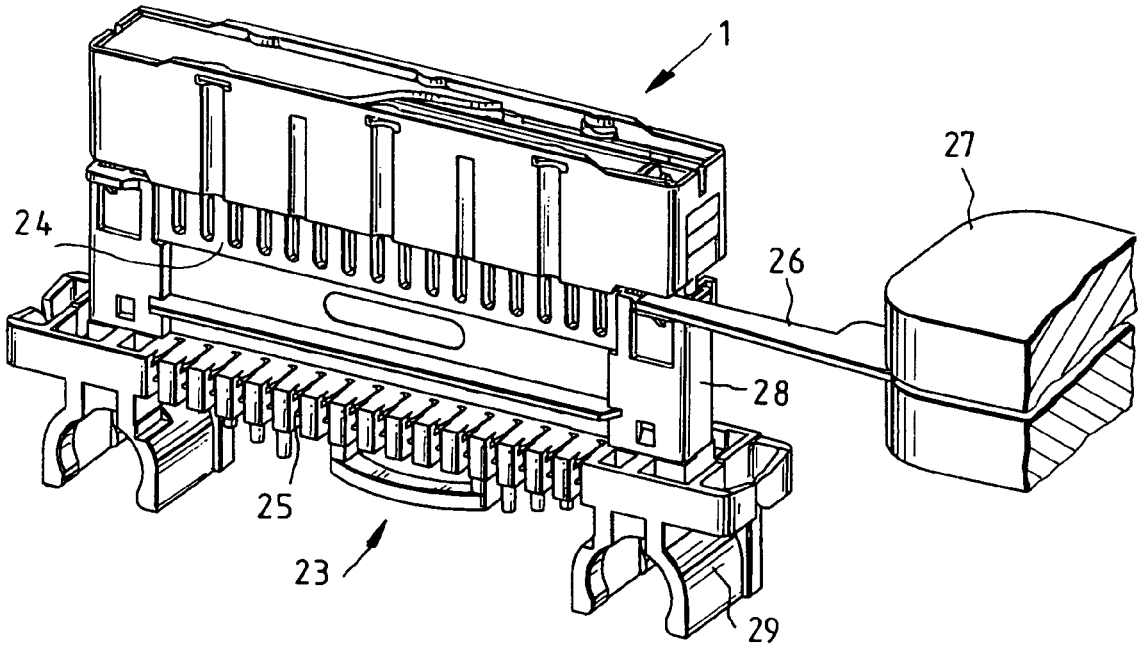
FIG. 4 shows a perspective illustration of a protection magazine plugged onto a distribution strip.

FIG. 4 shows the overvoltage protection magazine 1 plugged onto a contact strip 23. The contact strip 23 has two contact rows 25 which are arranged offset by 90° with respect to one another. In this case, the upper contact row 24 with the overvoltage protection magazine 1 plugged onto it is no longer accessible, whereas the second contact row 25 is freely accessible. Owing to the cutouts in the housing 2 in the region of the extensions 12, the overvoltage protection magazine 1 can be levered out using the blade 26 of a tool 27. When the overvoltage protection magazine 1 is plugged on, the plug-in regions 9 make contact with center taps (not shown in FIGS. 1-3) of the contact strip 23, as a result of which in each case one contact from the first and second contact rows 24, 25 is connected to an electrode of a surge arrester 4 (see FIG. 1). At the same time, the two ground contacts 6 in each case enter a cuboid region 28, where they make contact with a ground tap (not shown). The contact strip 23 can then be latched onto the profiled rods (not shown) by means of the clamp-like holder elements 29, the ground tap in this case making contact with the profiled rod. This brings about a conductive ground connection between the center taps of the surge arresters and the profiled rods.

LIST OF REFERENCE NUMERALS

1 Overvoltage protection magazine
2 Housing
3 Printed circuit board
4 Surge arrester
5 Insulator strip
6 Ground contacts
7 Center contacts
8 Contact pad
9 Plug-in region
11 Contact pad
12 Extensions
13 Recesses
14 Upper edge
15 Slots
16 End sides
17 Slopes
18 Slots
19 Dual fork contact
20 Single fork contact
21 Closed webs
22 Webs
23 Contact strip
24 Contact row
25 Contact row
26 Blade
27 Tool
28 Cuboid region
29 Clamp-like holder element

The invention claimed is:

1. An overvoltage protection magazine for a telecommunication device, comprising:

a housing having a top and a bottom, wherein the housing is integral, wherein the housing is open at the top and covered by an insulator strip, wherein inner sides of the housing are provided with supports for the insulator strip, wherein the housing is provided with a slot on at least one of end sides of the housing by means of which the insulator strip is configured to be levered out using a tool;

a printed circuit board arranged within the housing, the printed circuit board having a top, a bottom, a front, and a rear, the printed circuit board defining ground contact pads on opposite sides of the printed circuit board at the top of the printed circuit board, each of the ground contact pads extending from the front to the rear of the printed circuit board;

at least three adjacent surge arresters arranged on the printed circuit board in a single row, each surge arrester including a first outer electrode, a second outer electrode, and a center electrode, the center electrode of each surge arrester being electrically coupled to the ground contact pads via a conductor track on the printed circuit board; and at least one ground contact in the form of a forked contact coupled to the housing, the ground contact being configured to mate to at least one of the ground contact pads of the printed circuit board;

wherein a lower region of the printed circuit board defines cutouts that form plug-in regions corresponding to the surge arresters, wherein the outer electrodes of the surge arresters are associated with the corresponding plug-in region via conductor tracks on the printed circuit board, wherein each plug-in region includes a contact pad for each outer electrode of the corresponding surge arrester, each contact pad being arranged on the front and rear of the printed circuit board.

2. The overvoltage protection magazine as claimed in claim 1,wherein the surge arresters are in the form of SMD surge arresters.

3. The overvoltage protection magazine as claimed in claim 1, wherein the housing is provided with semicylindrical recesses which are provided with slots in a region adjacent the top of the housing, the insulator strip being passed between the slots.

4. The overvoltage protection magazine as claimed in claim 1, wherein edges at the top of the housing are set back at sides such that the insulator strip is flush with the top of the housing.

5. The overvoltage protection magazine as claimed in claim 1, wherein the surge arresters are fail-safe.

6. The overvoltage protection magazines as claimed in claim 1, wherein the contact pads of the printed circuit board are made of silver.

7. The overvoltage protection magazine as claimed in claim 1, wherein the bottom of the housing is provided with cutouts in a region adjacent the ground contacts.

8. An overvoltage protection magazine for a telecommunication device, the overvoltage protection magazine comprising:

a printed circuit board extending from a first end to a second end and having a front and a rear, the first end forming separate plug-in regions, each plug-in region defining a first contact pad and a second contact pad on the front of the printed circuit board and defining a first contact pad and a second contact pad on the rear of the printed circuit board, the second end of the printed circuit board defining a first ground contact pad at a first side and a second ground contact pad at an opposite, second side;

a plurality of surge arresters mounted to the printed circuit board in a single row at the second end of the printed circuit board, each surge arrester including first and second outer electrodes that couple to the first and second contact pads, respectively, of a corresponding one of the plug-in regions;

an integral housing defining an interior configured to receive the printed circuit board with the surge arresters, the integral housing having a first side defining a plurality of openings configured to receive the plug-in regions of the printed circuit board, the first side of the integral housing also including closed webs arranged to extend between the plug-in regions when the printed circuit board is arranged within the integral housing and slotted webs arranged to extend over the plug-in regions when the printed circuit board is arranged within the integral housing, wherein the integral housing defines a second side covered by an insulator strip, wherein inner sides of the housing are provided with supports for the insulator strip, wherein the housing is provided with a slot on at least one of end sides of the housing by means of which the insulator strip is configured to be levered out using a tool; and at least one ground contact in the form of a forked contact coupled to the housing, the ground contact being configured to mate to at least one of the ground contact pads of the printed circuit board.

9. The overvoltage protection magazine as claimed in claim 8, wherein the surge arresters are fail-safe.

10. The overvoltage protection magazines as claimed in claim 8, wherein the contact pads of the printed circuit board are made of silver.

11. The overvoltage protection magazine as claimed in claim 8, wherein the surge arresters are in the form of SMD surge arresters.

12. The overvoltage protection magazine as claimed in claim 8, wherein the insulator strip is flush with the second side of the integral housing.

13. The overvoltage protection magazine as claimed in claim 8, wherein sides of the integral housing define semicylindrical recesses.

14. The overvoltage protection magazine as claimed in claim 13, wherein the semicylindrical recesses define slots sized to receive the insulator strip.

* * * * *

UNITED STATES PATENT AND TRADEMARK OFFICE

CERTIFICATE OF CORRECTION

PATENT NO. : 7,583,488 B2
APPLICATION NO. : 10/553314
DATED : September 1, 2009
INVENTOR(S) : Neumetzler et al.

It is certified that error appears in the above-identified patent and that said Letters Patent is hereby corrected as shown below:

Col. 3, line 59: "contact rows 25 which are" should read --contact rows 24, 25 which are--

Signed and Sealed this

Sixteenth Day of March, 2010

David J. Kappos

David J. Kappos
*Director of the United States Patent and Trademark Office*